US012805616B2

(12) United States Patent
Burnsed, Jr.

(10) Patent No.: US 12,805,616 B2
(45) Date of Patent: Nov. 24, 2026

(54) ZIPPER CONFIGURATION FOR AN EXPANDABLE STORAGE COMPARTMENT

(71) Applicant: Blue Force Gear, Inc, Pooler, GA (US)

(72) Inventor: Ashley A. Burnsed, Jr., Savannah, GA (US)

(73) Assignee: Blue Force Gear, Inc., Pooler, GA (US)

( * ) Notice: Subject to any disclaimer, the term of this patent is extended or adjusted under 35 U.S.C. 154(b) by 123 days.

(21) Appl. No.: 18/802,605

(22) Filed: Aug. 13, 2024

(65) Prior Publication Data

US 2025/0057293 A1 Feb. 20, 2025

Related U.S. Application Data

(60) Provisional application No. 63/519,702, filed on Aug. 15, 2023.

(51) Int. Cl.
*A45C 7/00* (2006.01)
*A45C 13/30* (2006.01)

(52) U.S. Cl.
CPC ..... *A45C 7/0068* (2013.01); *A45C 13/30* (2013.01)

(58) Field of Classification Search
CPC ..... A45C 7/0063; A45C 7/0068; A45C 13/30; A45C 13/103
See application file for complete search history.

(56) References Cited

U.S. PATENT DOCUMENTS

| | | | | |
|---|---|---|---|---|
| 3,443,671 | A * | 5/1969 | Dyke | A45C 7/0027 383/61.3 |
| 4,773,515 | A * | 9/1988 | Kotkins, Jr. | A45C 7/0068 190/111 |
| 6,591,950 | B1 * | 7/2003 | Scicluna | A45C 7/0027 190/103 |
| 6,609,598 | B2 * | 8/2003 | Hsu | A45C 7/0027 190/103 |
| 8,978,850 | B2 * | 3/2015 | Bettua | A45C 7/009 190/103 |
| 10,653,230 | B1 * | 5/2020 | Wang | A45C 13/1023 |
| 12,150,539 | B1 * | 11/2024 | Mellen | A45C 7/0027 |
| 2007/0267262 | A1 * | 11/2007 | Sederoff | A45C 5/14 190/103 |

(Continued)

*Primary Examiner* — Derek J Battisti
(74) *Attorney, Agent, or Firm* — Eversheds Sutherland (US) LLP

(57) ABSTRACT

A storage compartment apparatus having a storage compartment with a first sidewall, a second sidewall, a back wall, a front wall, a base, and an opening opposite the base. The storage compartment having a first region and a second region. The first region configured to be positioned in either an expanded configuration or a collapsed configuration. The second region configured to be positioned in either an expanded configuration or a collapsed configuration. A first zipper is configured to move between an open positioned where the first region is movable to the expanded configuration and a closed positioned where the first region is in the collapsed configuration. A second zipper is configured to move between an open positioned where the first region is movable to the expanded configuration and a closed positioned where the first region is in the collapsed configuration. The first and second zippers being non-separating zippers.

19 Claims, 6 Drawing Sheets

(56) References Cited

U.S. PATENT DOCUMENTS

| | | | | |
|---|---|---|---|---|
| 2016/0120281 | A1* | 5/2016 | Oni | A45C 3/04 224/191 |
| 2017/0290398 | A1* | 10/2017 | Yu | A45C 5/06 |
| 2022/0110424 | A1* | 4/2022 | Rodgers | A45C 3/001 |
| 2024/0268532 | A1* | 8/2024 | Tieu | A45C 13/103 |

* cited by examiner

ZIPPER CONFIGURATION FOR AN EXPANDABLE STORAGE COMPARTMENT

REFERENCE TO RELATED APPLICATION

This application claims the benefit of U.S. Provisional Patent Application No. 63/519,702, filed on Aug. 15, 2023, the disclosure of which is incorporated herein by reference in its entirety.

BACKGROUND

Typically compartments or gussets on storage equipment have fully enclosed sides. Users may desire to have compartments which can have variable sizes depending on the need to store different items. Conventional separating zippers may separate and be difficult to rezip and fully enclosed compartments may be inconvenient. Separating zippers (e.g., jacket zippers) may require the user to reconnect the ends of the zipper before zipping up the zipper and this is less than ideal on a gusset of storage equipment.

SUMMARY

An aspect of the present disclosure relates to a storage compartment apparatus. The storage compartment apparatus includes a storage compartment defined by a first sidewall, a second sidewall, a back wall, a front wall, a base, and an opening opposite the base. The storage compartment includes a first region and a second region defining at least a portion of an interior of the storage compartment. The first region is configured to be positioned in either an expanded configuration or a collapsed configuration. The second region is configured to be positioned in either an expanded configuration or a collapsed configuration. A first zipper configured to move at least partially between an open position where the first region is movable to the expanded configuration and a closed position where the first region is moved to the collapsed configuration. A second zipper configured to move at least partially between an open position where the first region is movable to the expanded configuration, and a closed position where the first region is moved to collapsed configuration.

Another aspect of the present disclosure relates to a storage compartment apparatus. The storage compartment apparatus comprising a storage body and a storage compartment joined to the storage body, the storage compartment configured to expand to vary a holding capacity of an interior of the storage compartment. The storage compartment comprising a first zipper, a second zipper, and an opening to the interior. The first zipper is configured to move to expand a first region of the storage compartment. The second zipper is configured for moving to expand a second region of the storage compartment. An end of the storage compartment defines the opening.

Another aspect of the present disclosure relates to a backpack. The backpack including a main body including a main storage compartment. The backpack further including a storage compartment joined to the main body. The storage compartment configured to expand to vary a holding capacity of an interior of the storage compartment. The storage compartment further including a first zipper, a second zipper, and an opening to the interior. The first zipper is configured to move to expand a first region of the storage compartment. The second zipper is configured for moving to expand a second region of the storage compartment. The main body defines a portion of the storage compartment.

DETAILED DESCRIPTION

An aspect of the present disclose is to have a storage compartment with a non-sealed opening and the storage compartment is capable of expanding and collapsing. A two-zipper configuration having connected expandable first and second regions allows non-separating zippers to be used. The zippers may be non-separating zippers which make expanding and collapsing of the first and second regions easier.

Figure 1:
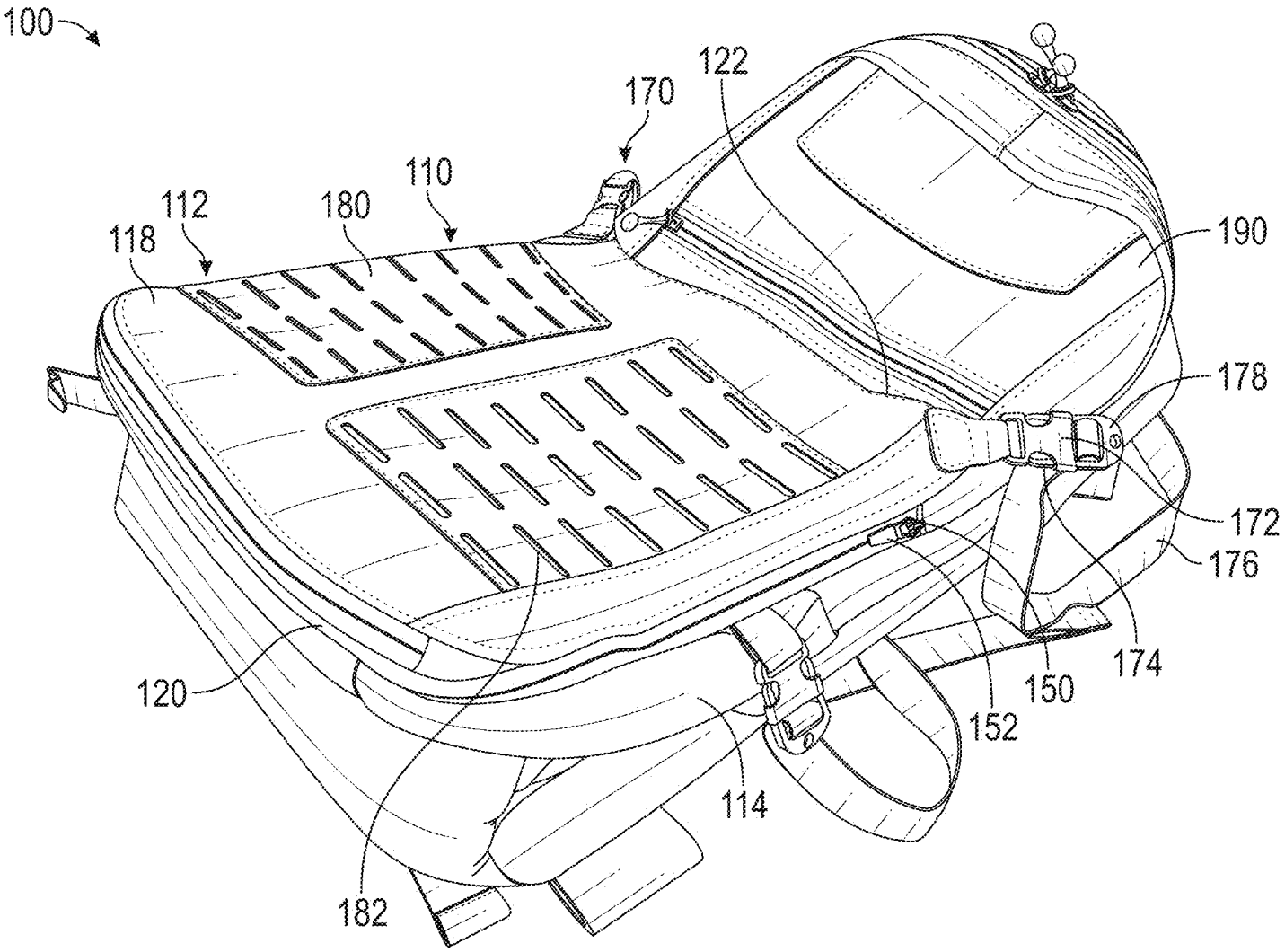
FIG. 1 is a perspective view of a storage compartment apparatus of the present disclosure in a collapsed configuration.
Figure 2:
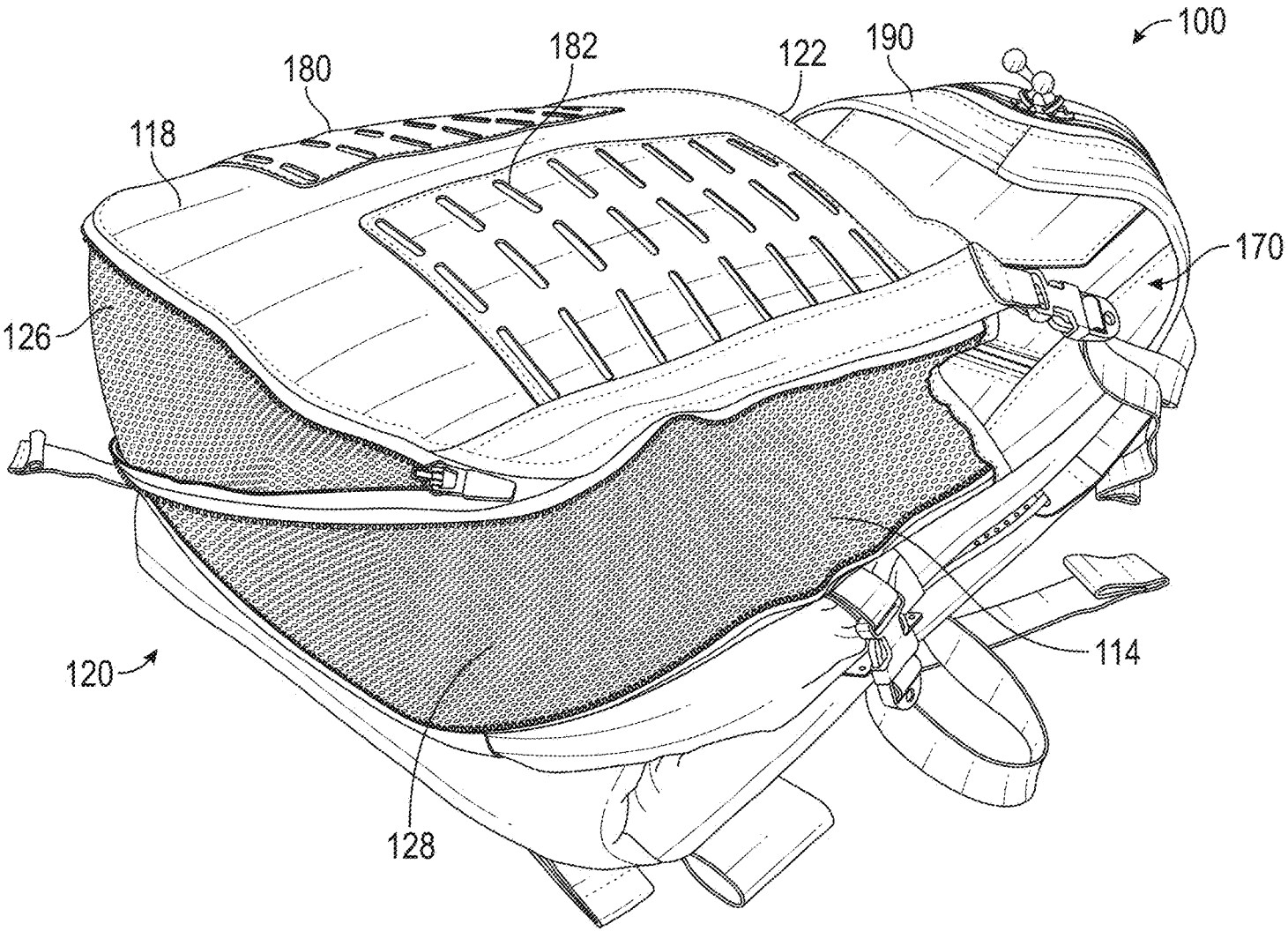
FIG. 2 is a perspective view of a storage compartment apparatus of the present disclosure in an expanded configuration.
Figure 3:
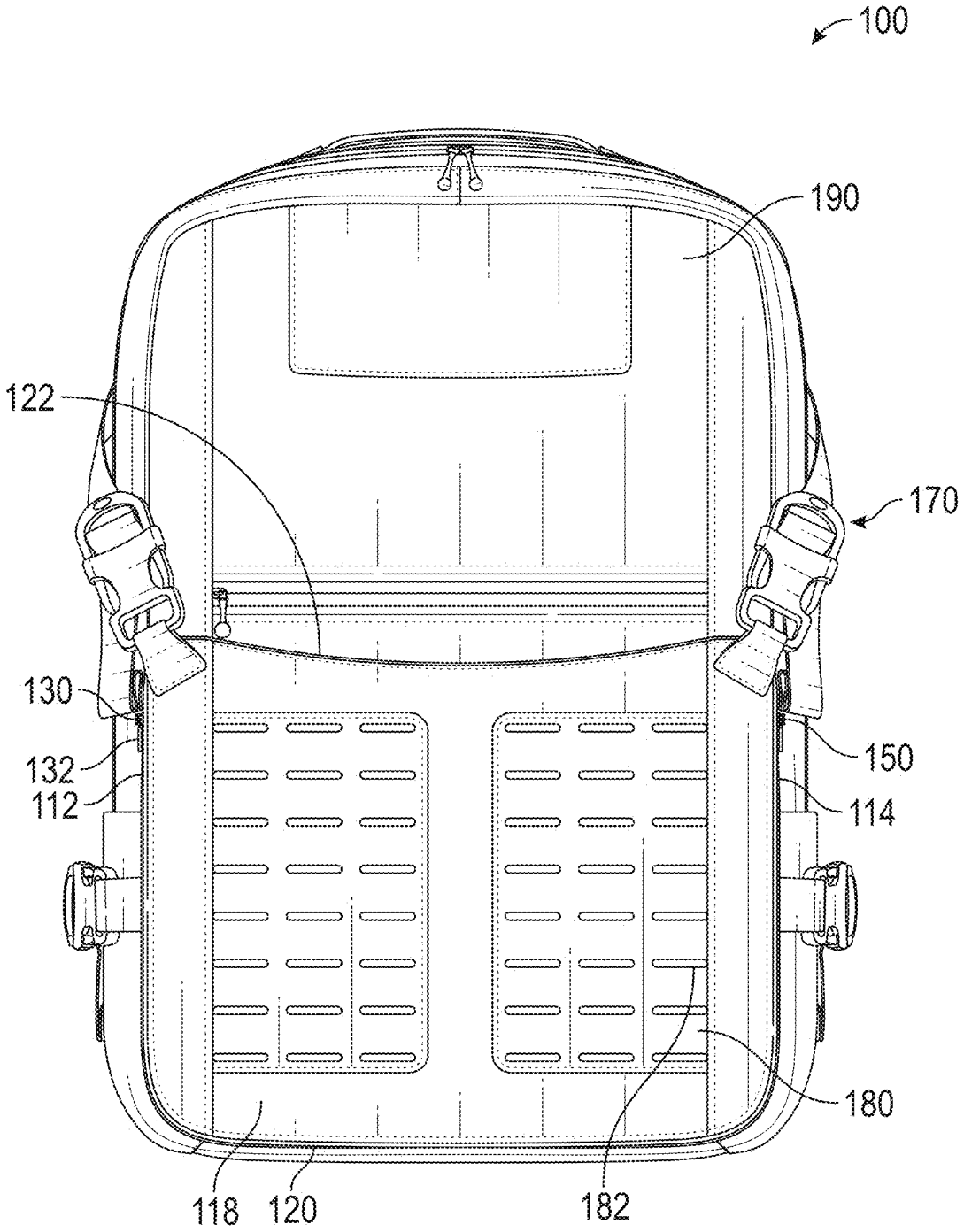
FIG. 3 is a front view of the storage compartment apparatus of the present disclosure.
Figure 8:
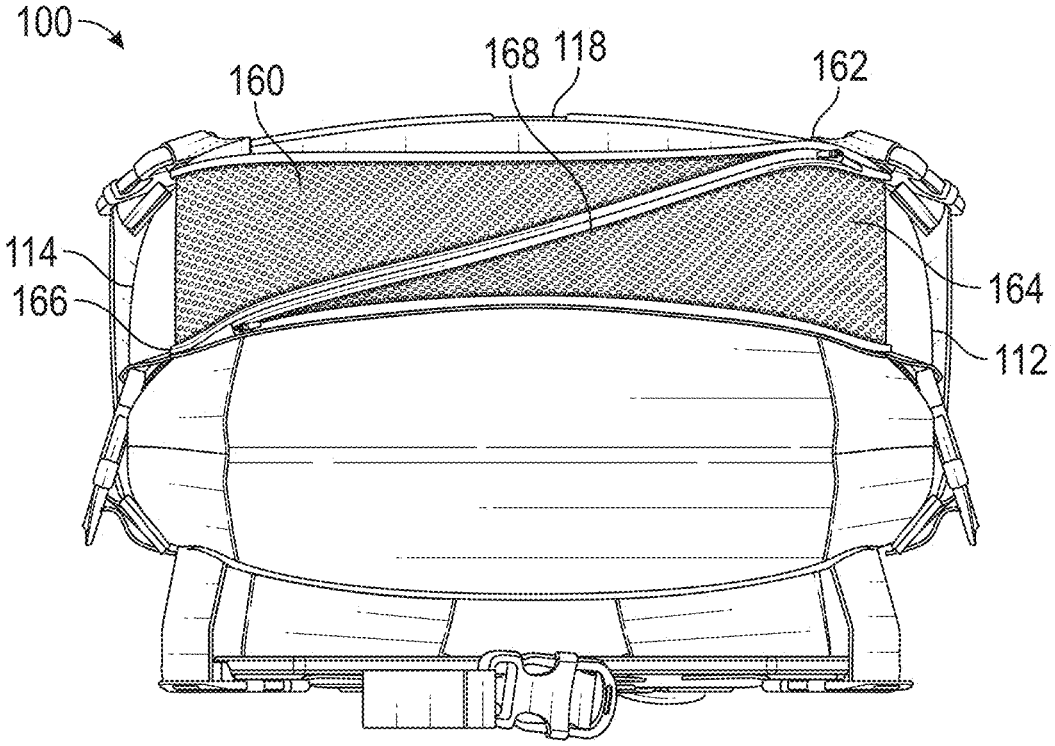
FIG. 8 is a bottom view of the storage compartment of the present disclosure in the expanded configuration.

FIGS. 1-3 illustrates a storage compartment apparatus 100 of the present disclosure. The storage compartment apparatus 100 may include a storage compartment 110, a first zipper 130, a second zipper 150, and a closing arrangement 170. The storage compartment 110 is defined by a first sidewall 112, a second sidewall 114, a back wall 116 (shown in FIG. 5), a front wall 118, a base 120, and an opening 122 opposite the base 120. In some instances, the storage compartment 110 may be referred to as a beavertail compartment. The storage compartment 110 including a first region 126 (shown best in FIG. 4) and a second region 128 (shown best in FIG. 4) of the storage compartment 110. The first and second regions 126, 128 defining at least a portion of an interior of the storage compartment. The first region 126 is configured to be positioned in either an expanded configuration or a collapsed configuration. The first region 126 may be defined by the first sidewall 112, the front wall 118, and a first portion 160 (shown in FIG. 8) of the base 120. The second region 128 is configured to be positioned in either an expanded configuration or a collapsed configuration. The second region 128 defined by the second sidewall 114, the back wall 116, and a second portion 164 (shown in FIG. 8) of the base 120. In some instances, the storage compartment 110 may referred to as a gusset.

The first zipper 130 includes a pull tab 132 (shown in FIG. 3). The first zipper 130 is joined to an exterior of first sidewall 112 and an exterior of the first portion 160 of the base 120. Further, the first zipper 130 is configured to move between an open position (shown in FIG. 2) where the first region 126 is movable between the expanded configuration and a closed position where the first region 126 is in the collapsed configuration (shown in FIG. 3). The pull tab 132 is used to move the first zipper 130 to the open and closed position. In some instances, the first zipper 130 may be moved between a plurality of positions partially between the open and closed positions to vary the amount the first region is expanded, such that the first region is only partially expanded. As the first zipper 130 is moved closer the open position, the first region is expanded more than when the zipper 130 closer to the closed position.

The second zipper 150 includes a pull tab 152. The second zipper 150 joined to an exterior of second sidewall 114 and an exterior of the second region 128 of the base 120. The second zipper 150 is configured to move between an open position (shown in FIG. 2) where the second region 128 is movable to the expanded configuration and a closed position where the second region 128 is in the collapsed configuration. The pull tab 152 moving the second zipper 150 to the open and closed position. In some instances, the second zipper 150 may be moved between a plurality of positions partially between the open and closed position to vary the amount the second region 128 is expanded, such that the second region 128 is only partially expanded. As the second zipper 150 is moved closer the open position, the second region 128 is expanded more than when the second zipper 150 is closer to the closed position.

In some examples, the first and second zippers 130, 150 may be non-separating zippers. Conventional storage compartments may have an opening 122 which is closed by a separating zipper. Users may find it difficult or irritating to have to reconnect the zippers when closing the storage compartment 110. Advantageously, the non-separating zippers are easier for a user to move the first and second regions 126, 128 between the expanded and collapsed configurations. Further, the opening 122 may be variably opened or closed as desired by the closing arrangement 170 separate from positioning of the zippers. As such, the storage compartments may be expanded and closed in a more convenient fashion to accommodate different sized object while still varying the opening 122 as necessary. It should be understood that the first and second zippers 130, 150 function as conventional zippers with teeth and a pull tab.

The closing arrangement 170 is configured to vary the size of the opening 122 of the storage compartment 110. The closing arrangement 170 includes at least one closing member. The closing member may be a male connector 172 and a female connector 174 joinable with the male connector. For instance, in some examples, the closing arrangement 170 includes at least one buckle 172 and clip 174 which are received within the buckles. Preferably, two pairs of buckles 172 and clips 174 are used to vary the opening 122 of the storage compartment 110. In some examples, at least one of either the clip 174 or buckle 172 includes an adjustable length strap 176 to vary the opening 122 size of the storage compartment 110. The adjustable length strap 176 may be wrapped through an adjustment body 178 (shown in FIG. 1) as conventionally used in backpacks for adjustable straps. In the example closing arrangement 170, the clip 174 includes the adjustable length strap 176 and the adjustment body 178. It is also understood that other means could be used as the closing member of the closing arrangement 170 to vary the size of the storage compartment's opening, such as a pull string or a hook and loop configuration, or other types of straps could be used.

The storage compartment 110 may be joined to a storage body 190. In some examples, the storage body 190 may be a main body of a backpack, bag, or case. For instance, in the example storage compartment apparatus 100, the storage body 190 is a backpack and the storage compartment 110 is joined to an exterior side of the backpack opposite a side with shoulder straps.

Referring to FIG. 3, an exterior of the front wall 118 of the storage compartment 110 may include a modular attachment surface 180. The modular attachment surface 180 includes slots 182 which allow the modular attachment of other objects. As a non-limiting example, the slots 182 may allow the insertion of straps of a modular attachment through the two of slots to join the attachment to the exterior surface of the front wall 118. As such, the storage compartment 110 may allow the attachment of other objects for further storage or directly holding an object on the modular attachment surface.

Figure 4:
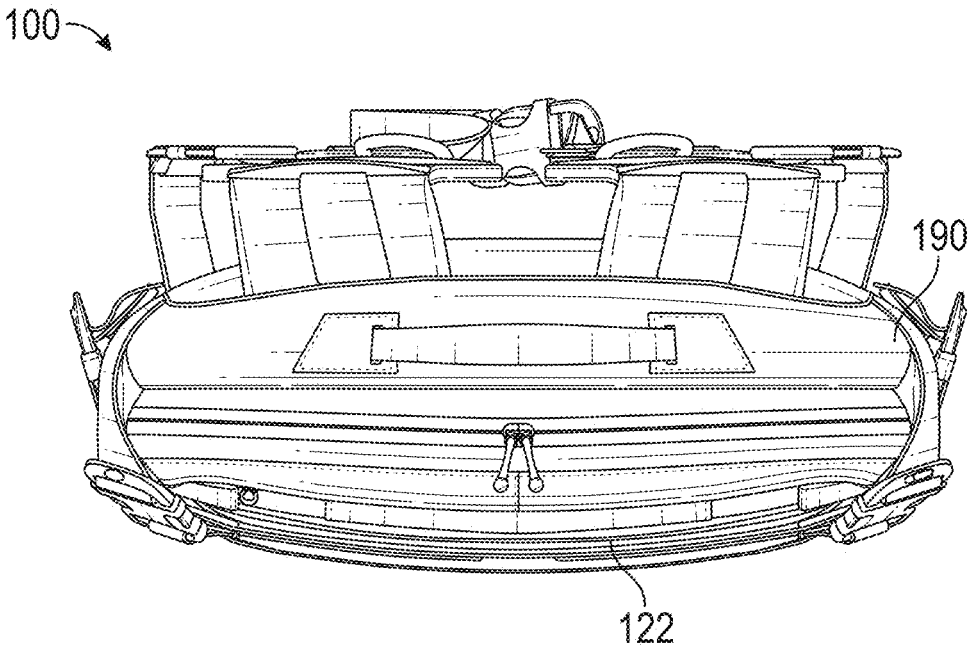
FIG. 4 is a top view of the opening of the storage compartment of present disclosure in the collapsed configuration.
Figure 5:
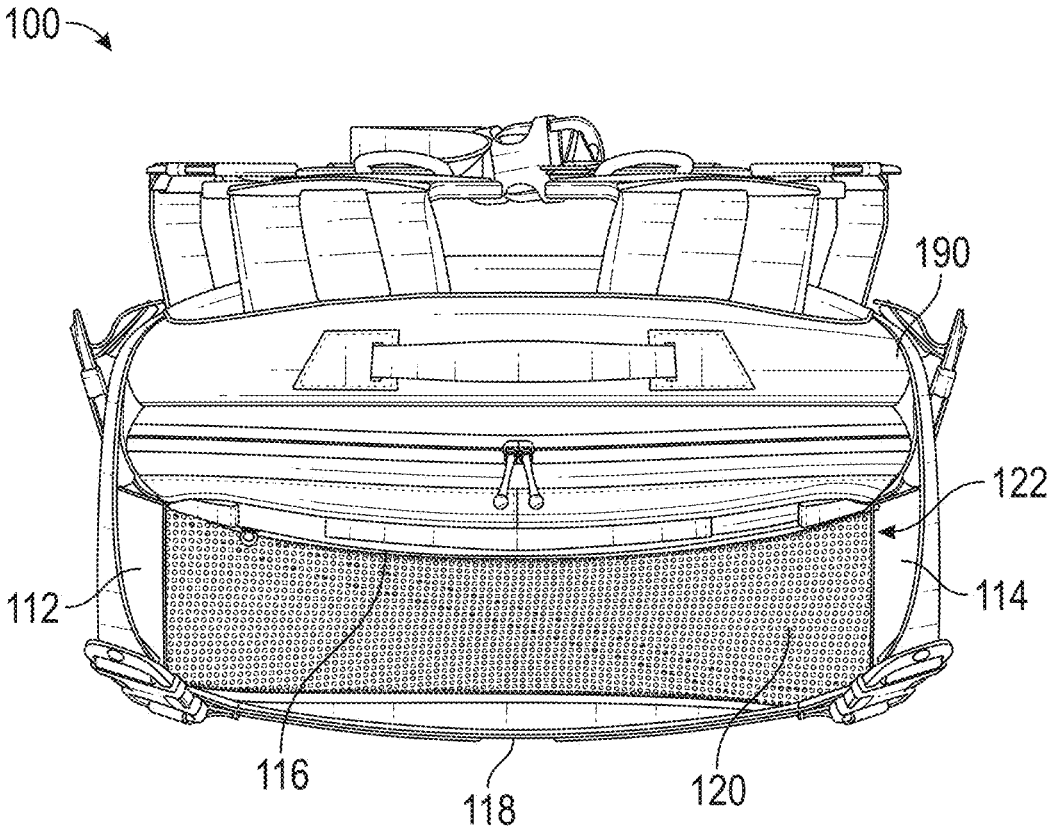
FIG. 5 is a top view of the opening of the storage compartment of present disclosure in the expanded configuration.
Figure 6:
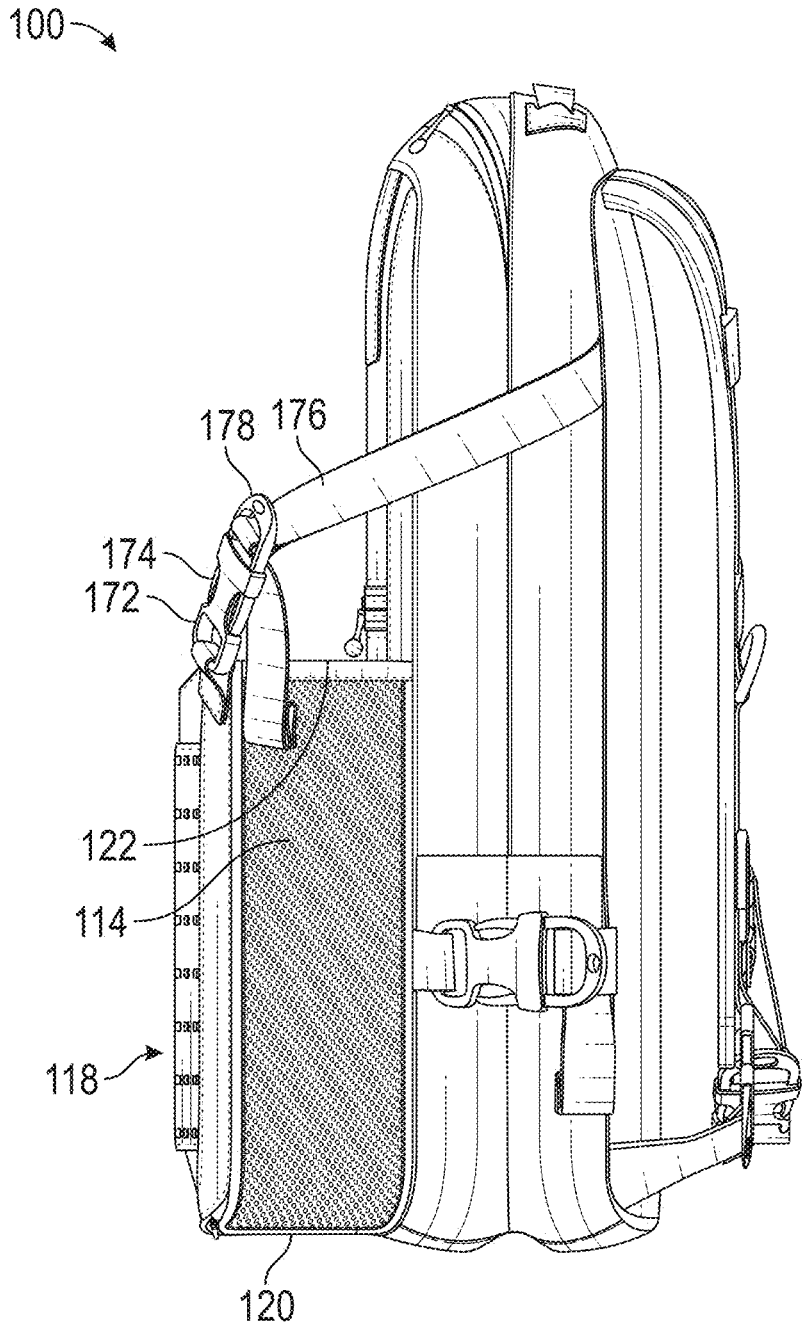
FIG. 6 is a side view of the storage compartment of the present disclosure in an expanded configuration.
Figure 7:
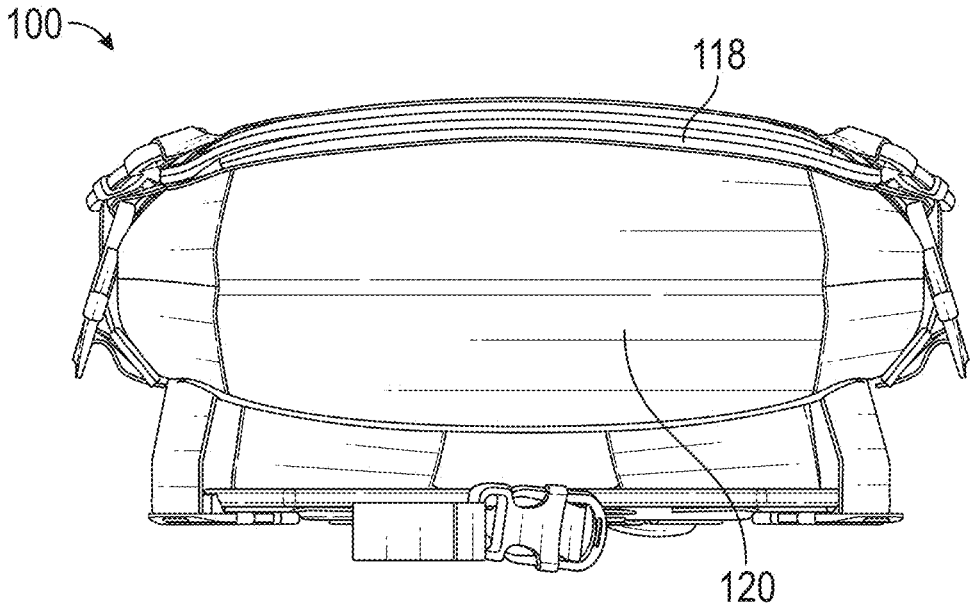
FIG. 7 is a bottom view of a storage compartment of the present disclosure in the collapsed configuration.

FIGS. 4 and 5 illustrates a top view of the opening 122 of the storage compartment 110 of present disclosure in the collapsed and expanded configurations. The storage compartment 110 may be part of a storage body 190, such as a backpack, bag, or case. In the example apparatus 100, the storage compartment 110 is attached to an exterior of the storage body 190. In some examples, the exterior of the storage body 190 may act as the back wall 116 of the storage compartment 110. The opening 122 of the storage compartment 110 allows for the insertion of objects into the single compartment formed by the first and second region 126, 128. In the collapsed configuration, each of the first and second region 126, 128 has a smaller volume than in the expanded configuration. Referring, to FIG. 5, when in the expanded configuration, the interior of the storage compartment 110 has an increased storage capacity. As shown, the first and second regions 126, 128 form a single storage compartment 110 in both the collapsed and expanded configurations. In the example storage compartment 110, the first and second regions 126, 128 are not separated by a barrier or layer through the interior. The opening 122 allows storage within storage compartment 110 regardless of whether either or both of the first or second regions 126, 128 are collapsed. For example, objects may still be stored in the storage compartment 110 when both the first and second regions 126,128 are collapsed. In some examples, the storage compartment 110 may be a plurality of storage formed by a divider or dividers within the interior of compartment 110.

As previously described, the opening 122 may have the degree of opening varied by the closing arrangement 170 (shown best in FIG. 3). The closing arrangement 170 includes the two pairs of buckles 172 and clips 174. In the example closing arrangement 170, the buckle 172 is joined to the front wall 118 of the storage compartment 110 and the clip 174 is joined to a surface of the storage body 190 extending beyond the opening 122 from the back wall 116 of the storage compartment 110. In other examples, the buckle 172 is joined to one of the front wall 118 or first and second sidewalls 112, 114 of the storage compartment 110. In some examples, the closing arrangement 170 may be diagonally attached to the front wall 118 from the surface of the storage body 190. Varying the size of the opening 122 may allow a user to optimize the retention of objects within the storage compartment 110 by constricting the opening around or over the object held in the storage compartment.

FIGS. 1, 2, and 6-8 illustrates the first and second sidewalls 112, 114 and base 120 of the storage compartment 110 in the collapsed configuration and the expanded configuration. As shown, each of the first region 126 and second region 128 may be positioned in the collapsed configuration (See FIG. 1). The example first zipper 130 is moved to the closed positioned which has restricted the first sidewall 112 inward toward the back wall 116. Similarly, the example second zipper 150 is moved to the closed positioned which has restricted the first sidewall 112 inward toward the back wall 116. In the example storage compartment apparatus 100, each of the first and second zippers 130, 150 are in a closed position, when the respective pull tabs 132, 152 are positioned at the opening 122 of the storage compartment 110. Each of the first and second zipper 130, 150 are in an open position when respective pull tabs 132, 152 are positioned at the base 120 of the storage compartment 110 (See FIG. 2). In other examples, the one or both of the first and second zippers 130, 150 may be reversely oriented, and the zippers may be in an open positioned with the pull tabs 132, 152 at the opening 122 and closed when the pull tabs are positioned at the base 120. The first and second zippers 130, 150 preferably are both in the open position when the pull tabs 132, 152 are positioned at the base 120.

When only the first region 126 is in in the expanded configuration, the first region 126 forms a triangular compartment. Similarly, when only the second region 128 is in the expanded configuration, the second region 128 forms a mirrored triangular compartment to the first region 126. The front wall 118 of the storage compartment 110 may be angled diagonally when the first region 126 in the expanded configuration and the second region is in the collapsed configuration. The front wall 118 of the storage compartment 110 may also be angled diagonally when the second region 128 in the expanded configuration and the first region 126 is in the collapsed configuration. The front wall 118 is oppositely angled such that the front wall 118 is mirrored to the other of the first or second regions, when one of the first or second regions is collapsed. In some examples, when both the first and second region 126, 128 are in the expanded configuration, the first and second region 126, 128 together form a generally rectangular storage compartment 110. In other examples, the zippers 130, 150 may expand the storage compartment 110 to other shapes.

The first and second zippers 130, 150 are joined by an intermediate region 168 (shown in FIG. 8) of the base extending diagonally across the base 120. For instance, the intermediate region 168 may extend from a corner 162 joining the front wall and second sidewall to a corner 166 of the base joining the backwall and first sidewall. The first zipper 130 may have a non-linear path. In the example apparatus 100, the first zipper 130 extends from a portion of the first sidewall 112 adjacent to the opening 122 to a first portion 160 of the base 120. For example, the first zipper 130 may extend to the corner 162 of the base 120 adjacent where the front wall 118 and the second sidewall 114 meet. The second zipper 150 extends from a portion of the second sidewall 114 adjacent to the opening 122 to a second portion 164 of the base 120. The first portion 160 of the base 120 is defined by the area between the intermediate region 168, the front wall 118, and the first sidewall 112. The second portion 164 of the base 120 is defined by the area between the intermediate region 168, the back wall 116, and the second sidewall 114. For instance, the second zipper 150 may extend to the corner 166 of the second portion 164 of the base 120 adjacent where the back wall 116 and the second sidewall 114 meet. When both the first and second zippers 130, 150 are open, the zippers form a Z-like configuration on the base 120. The first and second sidewalls 112, 114 collapse inwardly into the storage compartment 110. The first sidewall 112 and first portion 160 of the base 120 of the first region 126 are formed by a mesh material. The second sidewall 114 and second portion 164 of the base 120 of the second region 128 are formed by a mesh material. The intermediate region 168 defining a separate material between the mesh of the first and second regions 126, 128 at the base 120. However, in other examples, the first and second sidewalls 112, 114 and base 120 may be formed entirely form as the same material as the intermediate region 168 of the base 120. The intermediate region 168 is preferably formed by a sewn material; however, other well-known materials may be utilized. As a non-limiting example, a divider may be placed along the intermediate region 168 to separate the storage compartment 110 into a plurality of compartments.

Referring back to FIG. 1, the closing arrangement 170 of the storage compartment 110 can vary the size of the opening 122. The closing arrangement 170 includes the least two pairs of buckles 172 and clips 174. The buckles 172 mates with the clips 174. As a non-limiting example, the closing arrangement 170 are slide release buckles. In the example closing arrangement 170, the clip 174 includes the adjustment body 178 and is connected to the adjustable length strap 176. The adjustable length strap 176 may be inserted through the adjustment body 178 of the clip 174 and is cinched on the adjustment body 178 when the length of the strap is at its desired length. The adjustable length strap 176 may be lengthened to increase slack between the surface of the storage body 190 and clip or shorted to reduce slack. As such when clipped, the front wall 118 of storage compartment 110 is able to less constricted when buckled, and the opening 122 size is larger. In some examples, further buckle 172 and clips 174 may be positioned on sides of the storage body 190.

The various embodiments described above are provided by way of illustration only and should not be construed to limit the claims attached hereto. Those skilled in the art will readily recognize various modifications and changes that may be made without following the example embodiments and applications illustrated and described herein, and without departing from the full scope of the following claims.

What is claimed:

1. A storage compartment apparatus comprising: a storage compartment defined by a first sidewall, a second sidewall disposed opposite the first sidewall, a back wall, a front wall disposed opposite the back wall, a base, and an opening disposed opposite the base, the storage compartment including a first region and a second region defining at least a portion of an interior of the storage compartment; wherein the first region is configured to be positioned in either an expanded configuration or a collapsed configuration; wherein the second region is configured to be positioned in either an expanded configuration or a collapsed configuration; a first zipper configured to move at least partially between an open position where the first region is movable to the expanded configuration, and a closed position where the first region is moved to the collapsed configuration, wherein the first zipper is arranged in an L-shape and has a first end disposed along the base and a second end disposed along the first sidewall; and a second zipper configured to move at least partially between an open position where the second region is movable to the expanded configuration, and a closed position where the second region is moved to collapsed configuration, wherein the second zipper is arranged in an L-shape and has a first end disposed along the base and a second end disposed along the second sidewall, wherein the first zipper and the second zipper together form a Z-configuration when each of the first region and the second region are in the expanded configuration.

2. The storage compartment apparatus of claim 1, wherein the first region and the second region define at least one compartment.

3. The storage compartment apparatus of claim 1, further comprising a storage body defining a main storage compartment that is separate from the storage compartment.

4. The storage compartment apparatus of claim 3, wherein the storage compartment is disposed on an exterior of the storage body.

5. The storage compartment apparatus of claim 1, wherein when only the first region is in the expanded configuration, the first region forms a triangular compartment, and wherein when only the second region is in the expanded configuration, the second region forms a triangular compartment.

6. The storage compartment apparatus of claim 5, wherein when both the first region and the second region are in the expanded configuration, the first region and the second region form a generally rectangular storage compartment.

7. The storage compartment apparatus of claim 1, wherein the first zipper is configured such that mating strips of the first zipper do not separate from one another at the first end of the first zipper when the first zipper is in the open position, and wherein the second zipper is configured such that mating strips of the second zipper do not separate from one another at the first end of the second zipper when the second zipper is in the open position.

8. The storage compartment apparatus of claim 1, further comprising a closing arrangement joined to the storage compartment to vary a size of the opening of the storage compartment.

9. The storage compartment apparatus of claim 8, wherein the closing arrangement includes at least one male connector and at least one female connector engageable to the at least one male connector, and wherein one of the at least one male connector or the at least one female connector includes an adjustable length strap to vary the engagement of the at least one male connector and the at least one female connector and the size of the opening.

10. The storage compartment apparatus of claim 1, wherein the first region and the second region are formed of a mesh material.

11. The storage compartment apparatus of claim 1, wherein the first zipper and the second zipper are joined to an intermediate region, wherein the intermediate region is made from a different material than the first region and the second region.

12. A storage compartment apparatus comprising: a storage body; a storage compartment joined to the storage body, the storage compartment configured to expand to vary a holding capacity of an interior of the storage compartment; the storage compartment comprising a first zipper, a second zipper, and an opening to the interior, wherein the first zipper is configured to move to expand a first region of the storage compartment, wherein the second zipper is configured to move to expand a second region of the storage compartment, wherein the first zipper is arranged in an L-shape and has a first end disposed along a base of the storage compartment and a second end disposed along a first sidewall of the storage compartment, and wherein the second zipper is arranged in an L-shape and has a first end disposed along the base of the storage compartment and a second end disposed along a second sidewall of the storage compartment; and wherein an end of the storage compartment defines the opening, and wherein the first zipper and the second zipper together form a Z-configuration when each of the first region and the second region are in an expanded configuration.

13. The storage compartment apparatus of claim 12, wherein the opening is not closed by either the first zipper or the second zipper.

14. The storage compartment apparatus of claim 12, wherein the opening is disposed opposite the base of the storage compartment.

15. The storage compartment apparatus of claim 12, wherein the first region is at least partially made from a mesh material, and wherein the second region is at least partially made from a mesh material.

16. A backpack comprising: a main body including a main storage compartment; an expandable storage compartment joined to the main body, wherein the expandable storage compartment is configured to expand to vary a holding capacity of an interior of the expandable storage compartment; the expandable storage compartment comprising a first zipper, a second zipper, and an opening to the interior, wherein the first zipper is configured to move to expand a first region of the storage compartment, wherein the second zipper is configured to move to expand a second region of the storage compartment, wherein the first zipper is arranged in an L-shape and has a first end disposed along a base of the storage compartment and a second end disposed along a first sidewall of the storage compartment, and wherein the second zipper is arranged in an L-shape and has a first end disposed along the base of the storage compartment and a second end disposed along a second sidewall of the storage compartment; and wherein the main body defines a portion of the expandable storage compartment, and wherein the first zipper and the second zipper together form a Z-configuration when each of the first region and the second region are in an expanded configuration.

17. The backpack of claim 16, wherein the expandable storage compartment is defined by the first sidewall, the second sidewall disposed opposite the first sidewall, a back wall, a front wall disposed opposite the back wall, the base, and the opening disposed opposite the base, wherein the first region is defined by the first sidewall, the front wall, and a first portion of the base, and wherein the second region is defined by the second sidewall, the back wall, and a second portion of the base.

18. The backpack of claim 17, wherein the main body defines the back wall of the expandable storage compartment.

19. The backpack of claim 16, further comprising a closing arrangement joined to the expandable storage compartment to vary a size of the opening of the expandable storage compartment, wherein the closing arrangement includes at least one female connector and at least one male connector engageable to the at least one female connector, and wherein one of the at least one male connector or the at least one female connector includes an adjustable length strap to vary the engagement of the at least one female connector and the at least one male connector and the size of the opening.

* * * * *